US008857960B2

(12) United States Patent
Ng et al.

(10) Patent No.: US 8,857,960 B2
(45) Date of Patent: Oct. 14, 2014

(54) FLUID SUPPLY HOUSING

(75) Inventors: Teck Keong Ng, Singapore (SG); Thiam Teng Ong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 252 days.

(21) Appl. No.: 13/284,470

(22) Filed: Oct. 28, 2011

(65) Prior Publication Data

US 2013/0106956 A1 May 2, 2013

(51) Int. Cl.
*B41J 2/175* (2006.01)

(52) U.S. Cl.
CPC ..... *B41J 2/17553* (2013.01); *B41J 2/17513* (2013.01)
USPC ..... 347/87

(58) Field of Classification Search
USPC ..... 347/87
See application file for complete search history.

(56) References Cited

U.S. PATENT DOCUMENTS

| | | | | |
|---|---|---|---|---|
| 5,926,195 | A | 7/1999 | Domhoff et al. | |
| 6,260,961 | B1 | 7/2001 | Seu et al. | |
| 6,270,205 | B1 | 8/2001 | Takata | |
| 6,585,361 | B1 | 7/2003 | Jones | |
| 7,690,741 | B2 * | 4/2010 | Tyvoll et al. | 347/7 |
| 2004/0095447 | A1 | 5/2004 | Bailey et al. | |
| 2006/0092245 | A1 | 5/2006 | Stellbrink | |
| 2009/0096851 | A1 | 4/2009 | Sulser | |
| 2010/0132830 | A1 | 6/2010 | Rittgers et al. | |
| 2010/0238242 | A1 | 9/2010 | Rittgers et al. | |

FOREIGN PATENT DOCUMENTS

| | | | |
|---|---|---|---|
| CN | 1403287 | A | 3/2003 |
| EP | 1859944 | A1 | 11/2007 |
| JP | 59071868 | A | 4/1984 |
| WO | 2005102713 | A1 | 11/2005 |
| WO | 2008131602 | A1 | 11/2008 |
| WO | 2011066785 | A1 | 6/2011 |

* cited by examiner

*Primary Examiner* — Justin Seo
(74) *Attorney, Agent, or Firm* — Jan Frankhuizen

(57) ABSTRACT

A fluid supply housing includes a fluid chamber, a fluid slot distanced from the fluid chamber and a head surface. The fluid supply housing includes a fluid channel between the fluid chamber and the fluid slot. The fluid channel has a passageway that is straight and has a constant slope with respect to the head surface.

18 Claims, 6 Drawing Sheets

FLUID SUPPLY HOUSING

BACKGROUND

Fluid supplies can be used in printers or other fluid ejection mechanisms. Fluid supplies may contain capillary material to hold the fluid under a suitable back pressure. Certain fluid supplies are replaceable with respect to corresponding fluid ejection devices. Certain examples of replaceable fluid supplies have a head land containing fluid ejection actuators for ejecting the fluid directly from the replaceable fluid supply onto a substrate. Other examples of replaceable fluid supplies are arranged to be connected to a fluid ejection head containing fluid ejection actuators present in the fluid ejection device. Some fluid supply housings contain fluid slots for supplying the fluid, for example either directly to a substrate or to a fluid ejection head land for subsequent ejection. The fluid supply housings are provided with chambers for holding the fluid and channels to deliver the fluid to the fluid slots.

BRIEF DESCRIPTION OF THE DRAWINGS

For the purpose of illustration, certain examples of the present invention will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that also examples or elements that are not literally disclosed may be derived from the description and drawings by a person skilled in the art.

Figure 1:
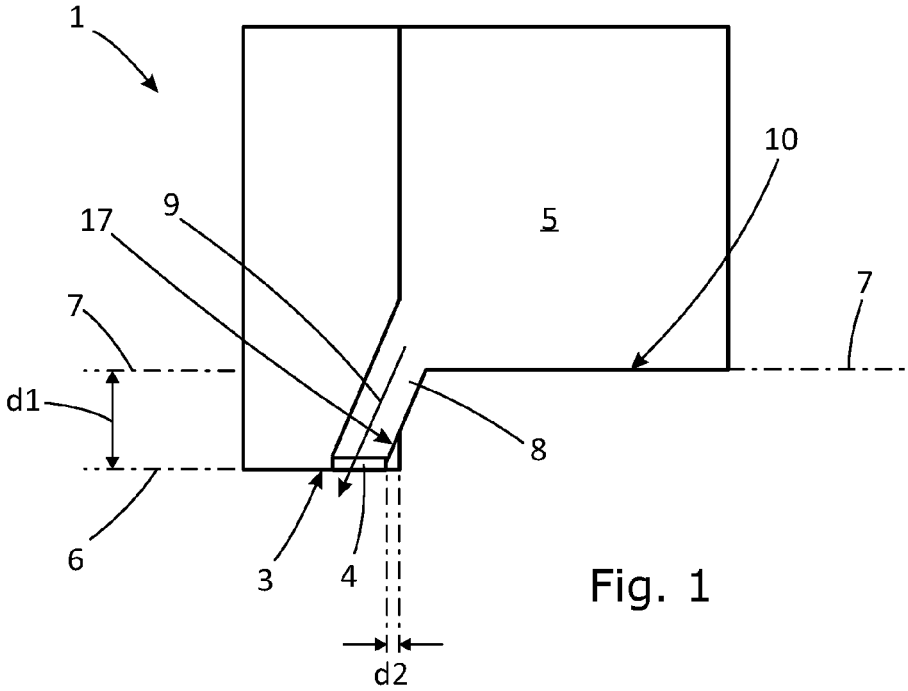
FIG. 1 shows a diagram of an example of a fluid supply housing in side view.

FIG. 1 shows an example of a fluid supply housing 1. The fluid supply housing 1 includes a head surface 3, at a first level 6. A fluid slot 4 extends through the head surface 3 for supplying the fluid to outside of the housing 1. The housing 1 includes at least one fluid chamber 5 for holding fluid. The fluid chamber 5 has a bottom 10 at a second level 7 that is distanced from the first level 6, by a first distance d1. In the orientation shown in the drawing the head surface 3 extends at a lower level 6 than the bottom 10.

The housing 1 includes a fluid channel 8 between the fluid chamber 5 and the fluid slot 4, for guiding the fluid toward the fluid slot 4 at the lower level 6. As can be seen, the fluid slot 4 may extend horizontally distanced from the fluid chamber 5 so that in the shown orientation fluid may travel both horizontally and vertically towards the fluid slot 4, through the fluid channel 8. The fluid channel 8 has an inclined orientation with respect to the bottom 10 of the chamber 5 and the head surface 3. The walls of the fluid channel 8 are straight and inclined. For example the fluid channel 8 has at least one inner wall 17 that has a constant slope with respect to the head surface 3. The fluid channel 8 and the inner wall 17 may extend from the chamber 5 up to the head surface 3. The fluid channel 8 has a straight passageway 9 that extends, without needing to curve, from the fluid chamber 5 to the fluid slot 4. The passageway 9 has constant slope with respect to the head surface 3, and for example also with respect to the bottom 10 of the fluid chamber 5. The passageway 9 may represent a straight way from the chamber through the fluid channel 8 and through the fluid slot 4.

In one example, the straight and constantly sloped passageway 9 facilitates entry of capillary material into the fluid channel 8 as well as a better fitting of the capillary material which in turn may provide for a better flow control in the fluid channel 8. For example the first distance may be larger than 3 millimeter or larger than 5 millimeter and the first distance may be larger than 1 millimeter or larger than 2 millimeter.

Figure 2:
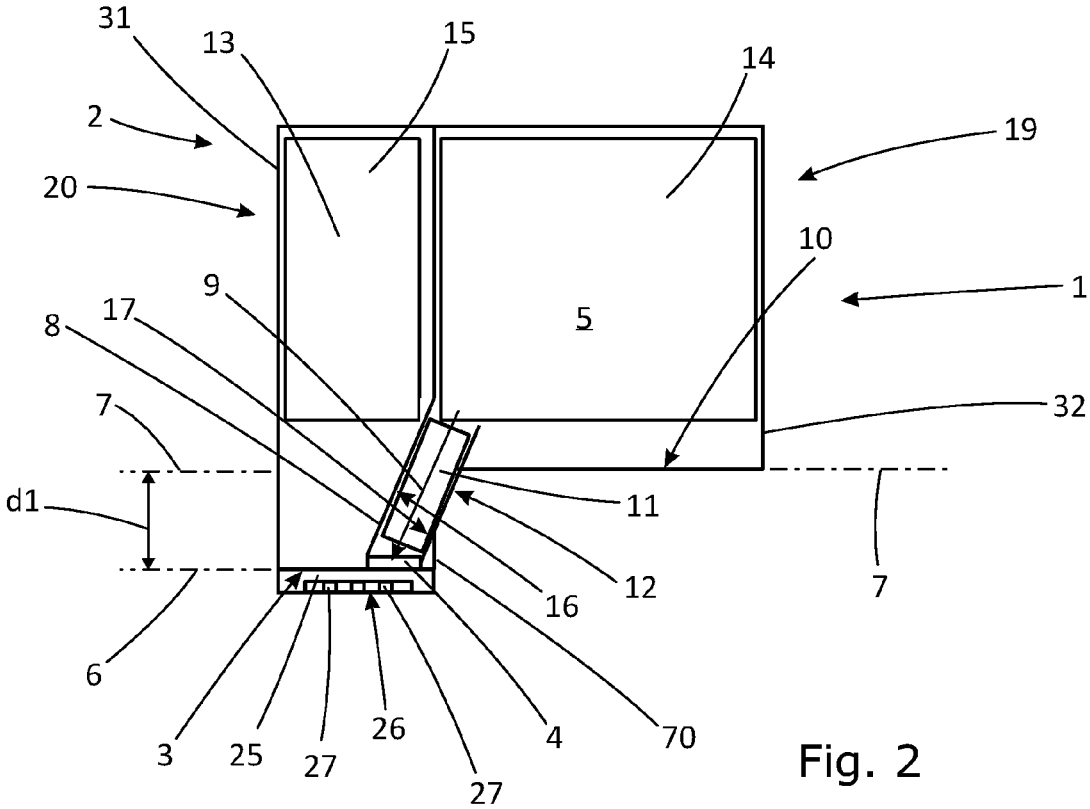
FIG. 2 shows a diagram of an example of a fluid supply in side view.

FIG. 2 shows an example of a fluid supply 2 including a fluid supply housing 1. In an example, the housing 1 includes two or three fluid chambers 5, 13, each chamber 5, 13 containing fluid of a different type with respect to fluid in the other chambers 5, 13. In an example, the entire housing 1 is a solid single cast piece, i.e. integrally and solidly formed by one mold filling. The example view of FIG. 2 shows a front chamber 13 containing fluid of a first type and a back chamber 5 containing fluid of a different type than the first type. In a further example, another back chamber is located next to the second chamber 5 (not shown in this view). The front chamber 13 resides at a front 20 of the housing 1. A front wall 31 at the front 20 of the housing 1 may be higher than a back wall 32 at a back 19 of the housing 1.

In the shown example the fluid channel 8 includes two straight, opposite walls 16, 17 that slope with respect to the chamber bottom 10 and the head surface 3. The sloping walls 16, 17 extend between the respective chamber 5 and fluid slot 4 approximately parallel to, and along, the sloping passageway 9. The front channel wall 16 may partly extend below the front chamber 13.

The fluid supply housing 1 may include a sloping outer wall 12 that extends along the fluid channel 8. The sloping outer wall 12 may extend between the bottom side of the bottom 10 of the chamber 5 and a standing wall 70 that extends upwards from the head surface 3. The sloping outer wall 12 extends parallel to the sloping channel walls 16, 17. The sloping outer wall 12 may be the outside of the inner sloping walls 17.

In an example, the fluid supply 2 includes a headland 25. The headland 25 includes a nozzle plate 26 with nozzle arrays for fluid ejection, and actuators 27 for actuating the fluid ejection out of the nozzles. The actuators 27 may include thermal actuators or piezo actuators. The actuators 27 may be connected to a further electric circuit for instructing the actuators 27. The headland 25 or parts of the headland 25 may have been manufactured by lithographic or other manufacturing techniques that allow formation of nozzles and circuits at nano or micro-level precision. The head surface 3 may be a part of the single cast housing 2. The headland 25 may be a separate part that is directly or indirectly adhered or otherwise mounted to the head surface 3. In a mounted condition of the headland 25, the nozzle arrays of the headland 25 are fluidically connected to the fluid slots 4.

In an example, the fluid supply 2 includes capillary material, for example in the form of foam blocks 11, 14, 15, that in use are soaked with at least a portion of the fluid in the chambers 5, 13. The foam 11, 14, 15 may provide for a backpressure in the fluid supply 2, for example to prevent unintentional dripping of fluid of the nozzles. In the shown example, a foam block 11 is arranged in the fluid channel 8 that extends between the respective chamber 5 and fluid slot 4.

The foam block 11 has an inclined orientation with respect to the head surface 3 and the bottom 10, for example against a parallel straight inner wall 16, 17. The foam block 11 may be adapted to fit in the fluid channel 8. In an example, the walls 16, 17 of the fluid channels 8 may be arranged so as to have a rectangular cross section. In an example, the foam block 11 has an approximately rectangle cross section and side walls at straight angles with respect to each other so as to fit in the fluid channel 8, abutting the straight inner walls 16, 17. Due to the corresponding straight shapes of the foam block 11 and the fluid channel 8 a better fitting and efficient insertion of the foam block 11 in the fluid channel 8 may be achieved.

In an example, the fluid supply housing 1 is a housing for an ink supply. The fluid may be ink, and the different fluid types may correspond to inks of different colors. The ink supply may be arranged to be replaced within a printer. In other examples, the fluid may be another gas or liquid, for example a pharmaceutical substance.

Figure 3:
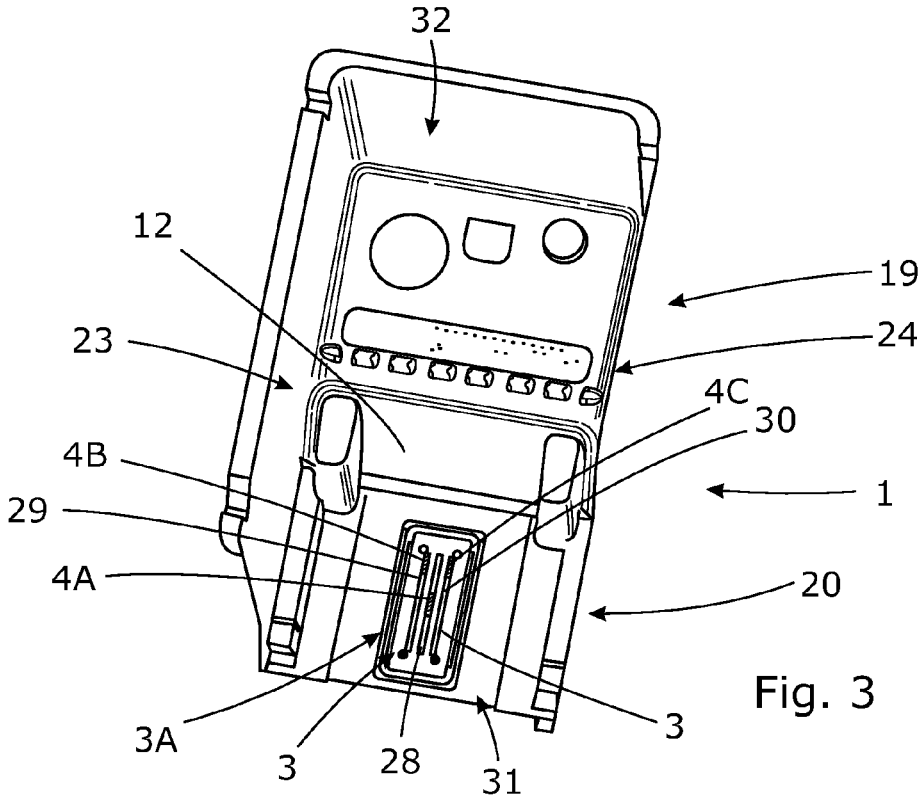
FIG. 3 shows a perspective view onto the bottom and side of an example of a fluid supply housing.
Figure 4:
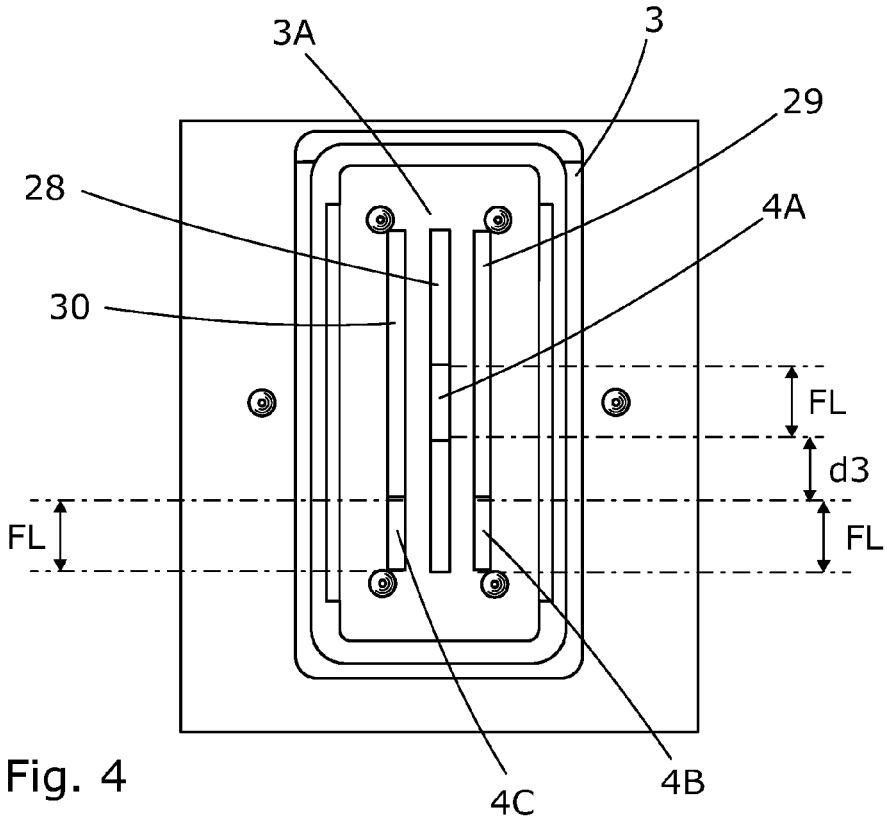
FIG. 4 shows a bottom view of an example of a portion of a head surface of the fluid supply housing of FIG. 3.
Figure 5:
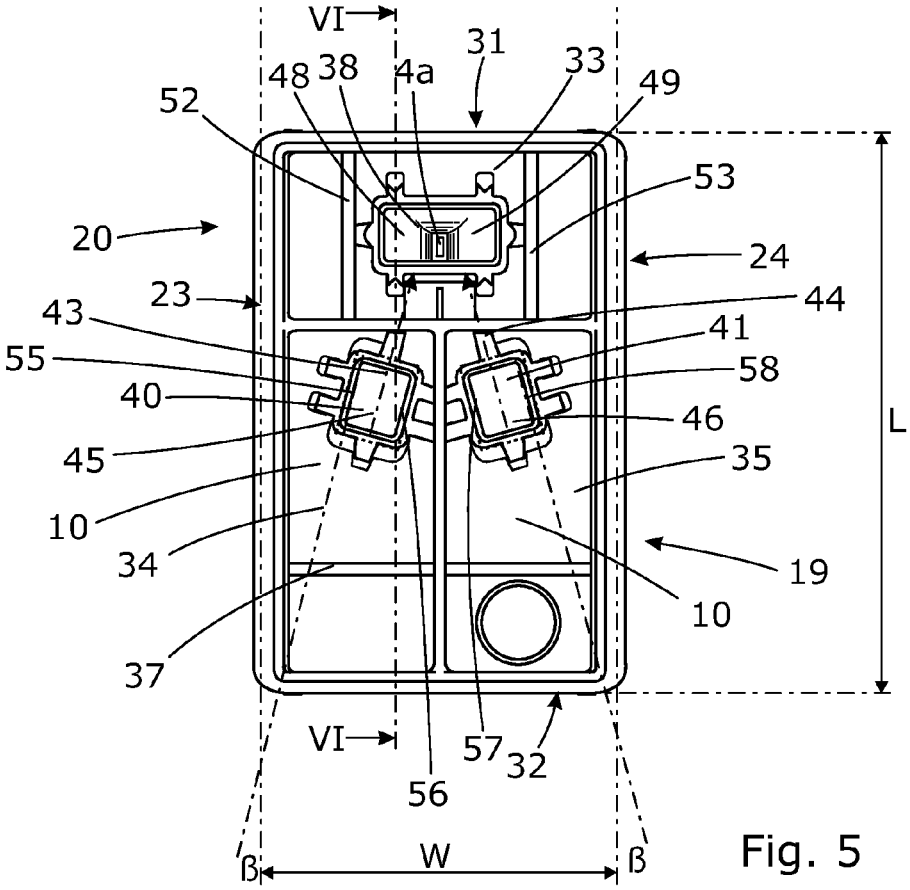
FIG. 5 shows a top view onto the inside of the fluid supply housing of the example of FIGS. 3 and 4.
Figure 6:
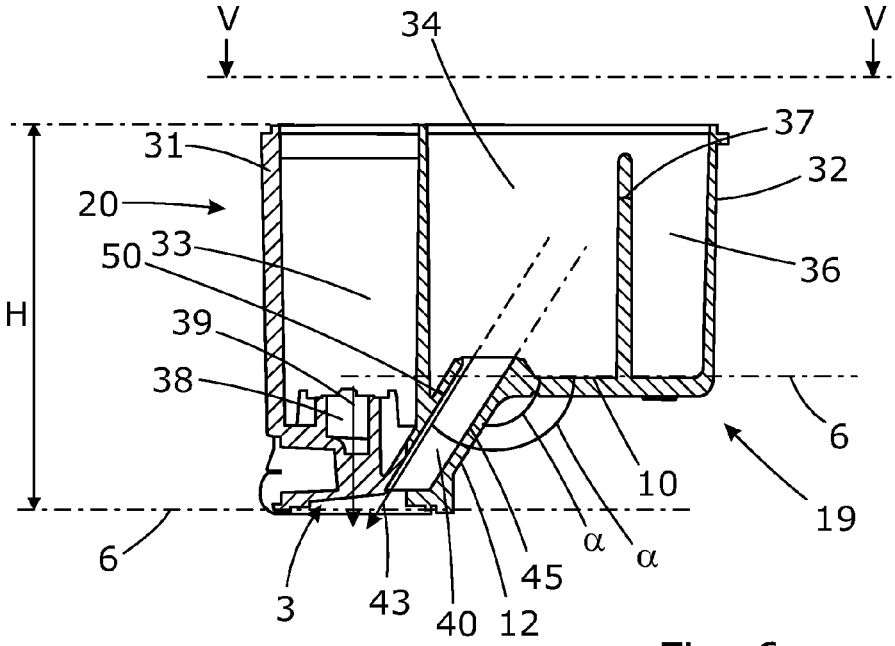
FIG. 6 shows a cross sectional side view of the example of FIGS. 3, 4 and 5.

FIG. 3 shows a perspective view on a bottom of an example of a fluid supply housing 1. FIG. 4 shows a detailed bottom view on the head surface 3 of the example fluid supply housing 1 of FIG. 3. FIG. 5 shows a top view on the example of the fluid supply housing 1 of FIGS. 3 and 4, as indicated by section line V-V in FIG. 6. FIG. 6 shows a cross sectional side view of the example of the fluid supply housing 1 of FIGS. 3, 4 and 5, as indicated by section line VI-VI in FIG. 5. In the shown examples, the fluid supply housing 1 is a solid single cast piece.

The fluid supply housing 1 of FIGS. 3-6 includes a front 20 and a back 19. The front 20 includes the head surface 3 for connecting the headland. The headland is not shown in FIGS. 3-6. A first chamber 33 is arranged in or near the front 20 and a second and third chamber 34, 35 are arranged in or near the back 19 (FIG. 5). The first chamber 31 is connected to a corresponding first fluid slot 4*a* through the first fluid channel 38. The first fluid channel 38 includes a first fluid passageway 39 extending straight downwards, from the first chamber 31 to the first fluid slot 4*a*. The second and third chamber 34, 35 are located between the first chamber 33 and the back wall 32 of the supply housing 1. The second and third chamber 34, 35 are connected to the corresponding second and third fluid slots 4*b*, 4*c* through corresponding second and third fluid channels 40, 41.

As can be seen from FIGS. 3 and 4, the head surface 3 includes a middle region 3*a* including longitudinal head channels 28, 29, 30 and fluid slots 4*a*, 4*b*, 4*c*. The head surface 3 includes a first longitudinal head channel 28 in the middle, and in parallel a second and third longitudinal head channel 29, 30 on both sides of the first longitudinal head channel 28. The first longitudinal head channel 28 is connected to the first chamber 33 by means of a first fluid slot 4*a* and a first fluid channel 38 (see FIG. 5). The second and third longitudinal head channels 29, 30 are connected to the second and third fluid chambers 34, 35, respectively, by means of respective second and third fluid slots 4*b*, 4*c* and respective second and third fluid channels 40, 41 (see FIG. 5). The longitudinal head channels 28, 29, 30 may comprise longitudinal cut outs in the head surface 3, as molded in the single cast housing 1. When the headland is connected to the head surface 3 and the housing 1 is at least partly filled with fluids, the fluids may reside in the respective longitudinal head channels 28, 29, before flowing to the headland.

In the arrangement shown in FIGS. 3 and 4, the head surface 3 includes a first fluid slot 4A in the middle between side walls 23, 24, and a second and third fluid slot 4B, 4C at both sides of the first fluid slot 4A. The fluid slots 4A, 4B, 4C are through holes extending in the respective longitudinal head channels 28, 29, for supplying the fluid to the longitudinal head channels 28, 29, 30. In an example, because of straight passageways 9, 39, 43, 44 to the fluid slots 4*a*, 4*b*, 4*c*, the respective first, second and third fluid channels 38, 40, 41 and the corresponding fluid slots 4*a*, 4*b*, 4*c* can be molded with the aid of one straight mold plug, for example an extendable mold plug that extends over a single straight central axis that extends parallel to the respective fluid passage ways 9, 39, 43, 44 of the fluid channels 38, 40, 41.

The fluid slots 4*a*, 4*b*, 4*c* may reside at least partly below the first chamber 33. In the shown example, the first fluid slot 4A is arranged closer to the front wall 31 of the fluid supply housing 1 than the second and third fluid slot 4B, 4C that are arranged at equal distance to the front wall 31 of the fluid supply housing 1. This may allow that the straight passageways 39, 43 extend through the respective fluid slots 4*a*, 4*b*, 4*c*. The second and third fluid slot 4*b*, 4*c* may be arranged at the end of the respective longitudinal head channel 29, 30 that is away from the front wall 31. The first fluid slot 4*a* is arranged closer to the front wall 31 than the second and third fluid slots 4*b*, 4*c*. In an example the fluid slots 4*a*, 4*b*, 4*c* have lengths FL of approximately 2 millimeters or less, for example approximately 1.85 millimeters. The lengths FL are less than half or less than a quarter of the longitudinal head channels 28, 29, 30. For example, the first fluid slot 4*a* has a pitch d3 of between approximately 1 and 3 millimeters with respect to the second and third fluid slot, for example approximately 1.89 millimeters. The longitudinal head channels 28, 29, 30 have lengths that are adapted to correspond to the nozzle arrays of the headland channels.

The fluid slots 4*a*, 4*b*, 4*c* are arranged in a middle region 3*a* of the head surface 3. The second and third fluid channels 40, 41 may be diverge towards the middle section 3*a* for guiding the fluid towards the second and third fluid slots 4*b*, 4*c*. As can be seen from FIG. 5, in an example the second and third fluid channel 40, 41 each include two opposite side walls 55, 56, 57, 58 that have an angle β with respect to the side walls 23, 24 of the housing 1, of between approximately 2° and approximately 30°, for example of between approximately 10° and approximately 20°, for example of between approximately 13° and approximately 17°, or of approximately 15° with respect to the housing side walls 23, 24.

The second and third fluid channels 40, 41 include respective passageways 43, 44 that have a constant slope with respect to the head surface 3 or the bottom 10. For example, the passageways 43, 44 have an angle α of between approximately 100° and approximately 150° with respect to the head surface 3, for example of between approximately 113° and approximately 133°, for example of between approximately 120° and approximately 126°, for example of approximately 123°, as seen from the side view of FIG. 6. For example, the passageways 43, 44 may be parallel to at least one of the sloping channel walls 45, 46, 50. The foam blocks 11 and the sloping channel walls 45, 46, 50 may have an angle α of between approximately 100° and approximately 150° with respect to the head surface 3, for example of between approximately 113° and approximately 133°, for example of between approximately 120° and approximately 126°, for example of approximately 123°, as seen from the side view of FIG. 6. In the example, the respective second and third fluid channels 40, 41 have substantially rectangular cross-sections, with margins or round corners for example for mold plug release or foam block positioning.

In an example, a suitable back pressure is provided by the capillary material in the fluid channels 40, 41 as arranged under said the angles α, β, during the lifetime of the fluid supply 1, while gaining manufacturing efficiency in terms of material and cost.

The second and third fluid channel 40, 41 extend in a sloping manner from a bottom 10 of the second and third chamber 34, 35 to the second and third fluid slots 4*b*, 4*c*, which are located under the first chamber 33 and at a lower level 6 than the level 7 of the bottom 10 of the second and third chambers 34, 35. A portion of the second and third fluid channel 40, 41 may extend in or under the first fluid chamber 33.

The second and third fluid channels 40, 41 have channel front walls 50 that may have approximately the same slope as said inclined inner walls 45, 46, or for example have a marginal difference for mold plug release. The channel front walls 50 of the second and third fluid channels 40, 41 may extend partly under or in the first chamber 33, so as to guide the fluid to the second and third fluid slots 4*b*, 4*c*.

In a further embodiment, the inclined outer wall 12 that is formed by the second and third fluid channel 40, 41 has an similar slope as the sloping inner walls 45, 46 for example of between approximately 113° and approximately 133° with respect to the head surface 3 or the bottom 10, for example of between approximately 120° and approximately 126°, for example of approximately 123°.

In an example, at least one further chamber 36 may be provided between the back wall 32 and the second and third chambers 34, 35 (see FIG. 6). The housing may include at least one inner back separation wall 37 to provide for the further chamber 36. The location of the inner back separation wall 37 may be adapted to determine an inner volume of the second and third chambers 34, 35. Likewise, in an example the inner volume of the first chamber 33 on the front of the housing 1 may be defined by one or two front separation walls 52, 53 (see FIG. 5).

Straight fluid passageways 43, 44 extend within the second and third fluid channels 40, 41. The fluid passageways 43, 44 may slope both downwards and inwards. For example, the fluid passageways 43, 44 may slope inwards because they are arranged at an angle with respect to side walls 23, 24 of the fluid supply housing, in a direction towards the middle of the head surface 3, to connect to the second and third fluid slots 4*b*, 4*c*, respectively. The fluid passageways 43, 44 may slope downwards because they are inclined with respect to the head surface 3, sloping downwards in a continuous manner, towards the respective second and third fluid slots 4*b*, 4*c*.

Figure 7:
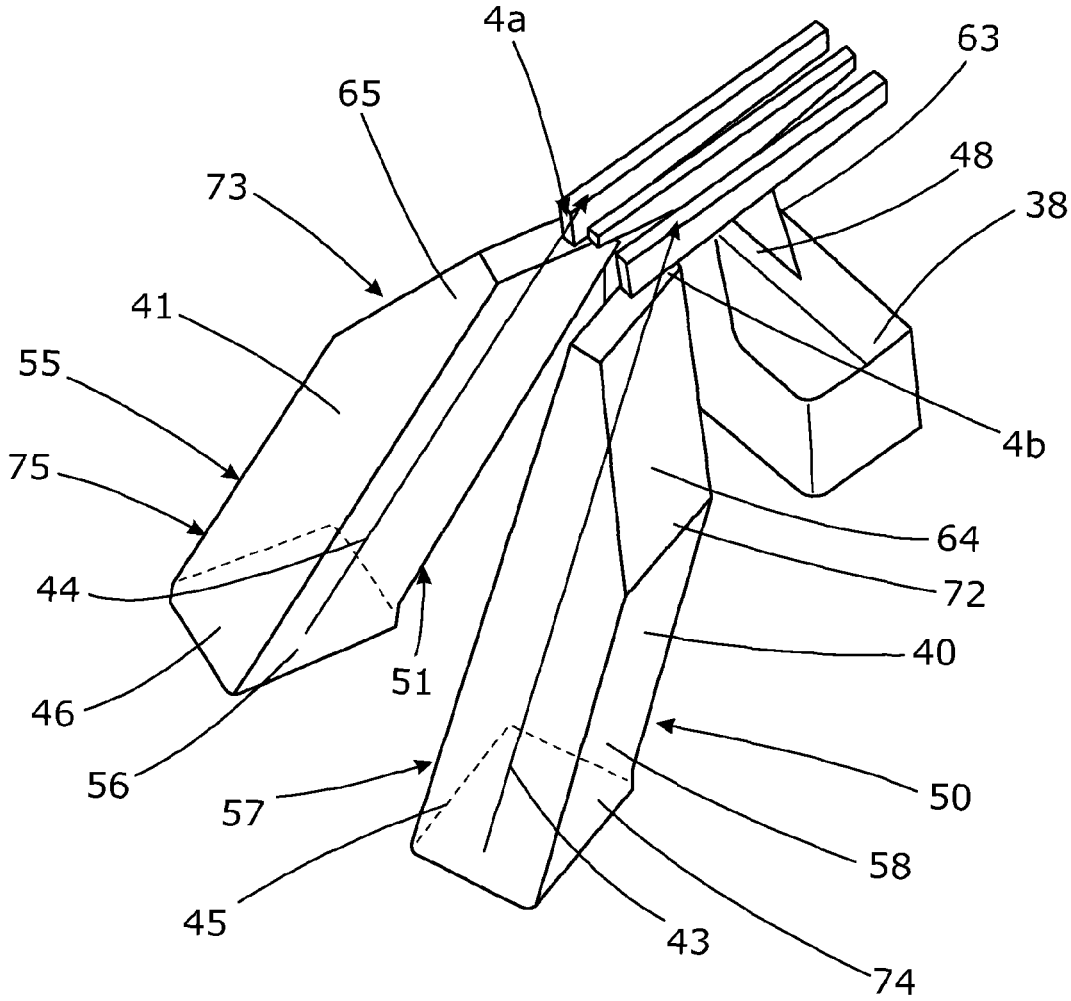
FIG. 7 shows a diagrammatic perspective view of example fluid channels of the example fluid supply housing of FIGS. 3-6.

In a further example, the fluid channels 38, 40, 41 are wedge shaped towards the fluid slots 4*a*, 4*b*, 4*c*, respectively, close to the fluid slots 4*a*, 4*b*, 4*c*. FIG. 7 illustrates the respective first, second and third fluid channels 38, 40, 41, separate from the rest of the housing 1 from a perspective view directed to the bottom of the housing 1. The respective fluid channels 38, 40, 41 may include wedge shaped portions 63, 64, 65, respectively, defined by diverging portions of side walls 48, 49, 55, 56, 57, 58 of the fluid channels 38, 40, 41.

Inner side walls 56, 57 of the second and third fluid channel 40, 41, respectively, may be substantially straight along the length of the fluid channel 40, 41, up to the respective fluid slot 4*b*, 4*c*. Outer side walls 55, 58 of each second and third fluid channel 40, 41 may include respective inwards inclining portions 72, 73 relative to the upper portions 74, 75 of the walls 55, 58, near to the fluid slots 4*b*, 4*c*, that incline towards the opposite inner side walls 56, 57 of the fluid channels 40, 41, respectively, defining the wedge shaped portions 64, 65, for guiding the fluid to the respective fluid slots 4*b*, 4*c*.

FIG. 7 also illustrates the first, second and third longitudinal head channels 28, 29, 30 that are connected to the fluid channels 38, 40, 41 through the respective fluid slots 4*a*, 4*b*, 4*c* on one side, and on the other side may be connected to channels of a headland (not shown).

The example housings 1 discussed with reference to FIGS. 3-7 may each be arranged for holding a volume of fluid of between approximately 0.10 to 1000 centiliters, or 0.10 to 10 centiliters in each chamber 33, 34, 35. In certain examples, a width W, height H and length L of the housing 1 may range from approximately 0.5 centimeters, 1 centimeters, and 1 centimeters, respectively, up to approximately 10 centimeters, 20 centimeters and 20 centimeters, respectively, or up to approximately 3 centimeters, 5 centimeters and 5 centimeters.

Figure 8:
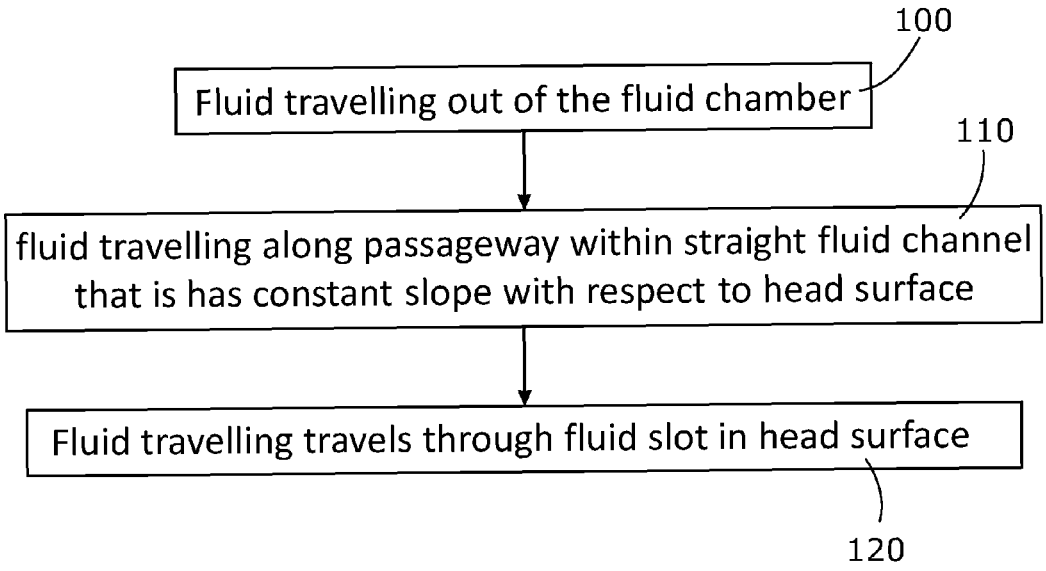
FIG. 8 shows a flow chart of an example of a method of supplying fluid.

FIG. 8 shows a flow chart of an example of a method of supplying fluid. For example, the method includes fluid travelling within capillary material of a fluid supply housing 1. For example, the fluid travels out of a fluid chamber 5 (block 100), to the fluid slot 4 that is provided in the head surface 3, distanced from the fluid chamber 5. For example, the fluid travels through capillary material 11 along a straight passageway 9 that is sloped at an angle of between approximately 113° and 133°, or between approximately 120° and 126°, with respect to the head surface 3 of the fluid supply housing 1 (block 110) and that extends from the fluid chamber 5 up to the fluid slot 4. For example, the fluid travels through the fluid slot 4 in the head surface 3 (block 120).

Figure 9:
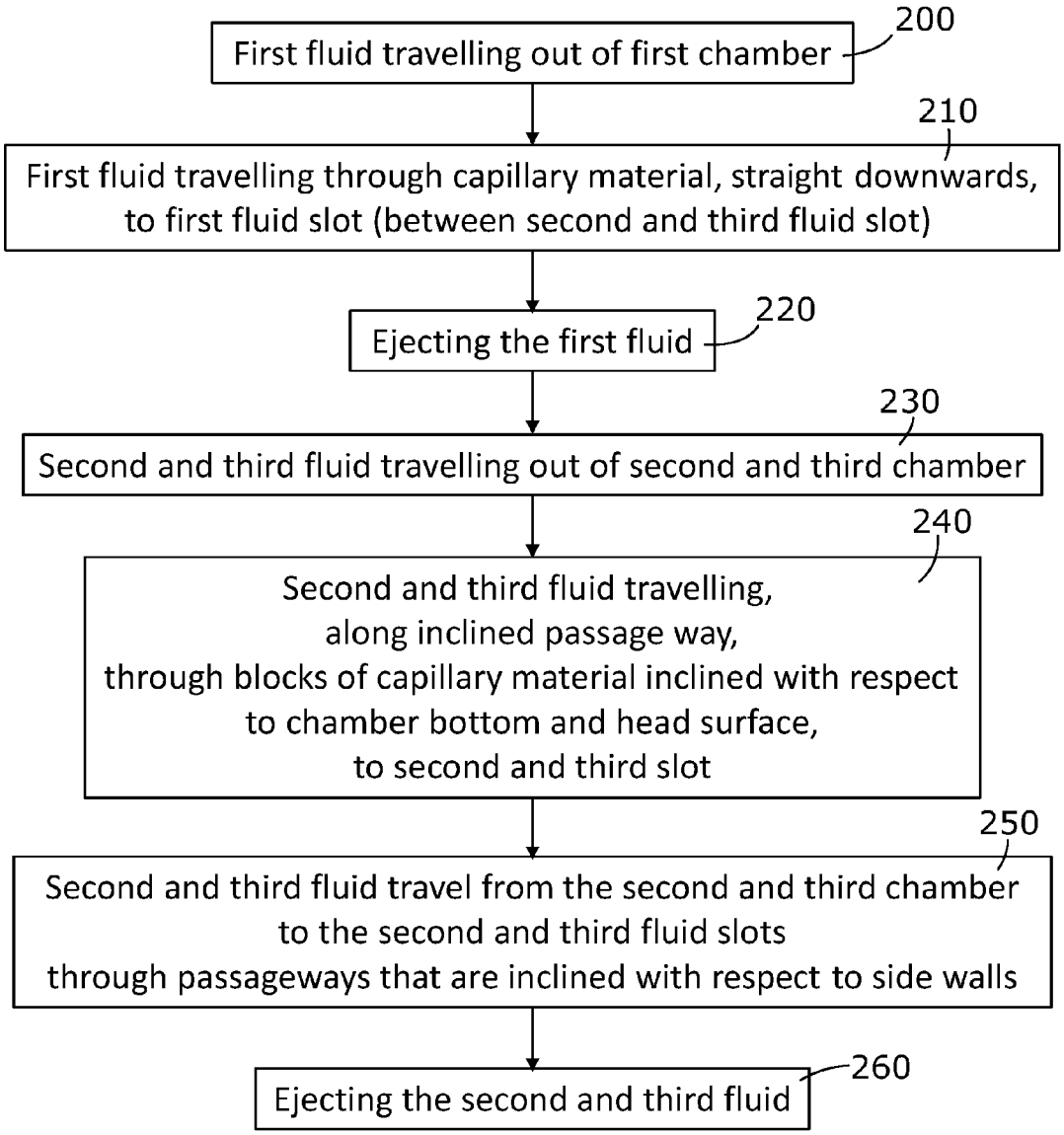
FIG. 9 shows a flow chart of another example of a method of supplying fluid.

FIG. 9 shows another flow chart of an example of a method of supplying fluid. For example, the method includes a first fluid of a first type travelling out of a first fluid chamber 33 (block 200). For example, the first fluid travels through capillary material 11, 14, 15, relatively straight downward from the first chamber 33 to the first fluid slot 4*a* (block 210). For example, the method includes ejecting the first fluid out of the first slot 4*a* (block 220). For example, a second and third fluid being of a second and third type different then the first type travels out of a second and third chamber 34, 35 (block 230), respectively, to a corresponding second and third fluid slot 4*b*, 4*c*, respectively, along an inclined passageway 9, through second and third capillary blocks 11 that have an angle α with respect to the bottom 10 and the head surface 3 (block 240), sloping downwards. For example, the second and third fluid travel from the respective second and third chamber 34, 35 to the second and third fluid slots 4*b*, 4*c*, respectively, through passageways 9 that are inclined inwards, under an angle β with respect to side walls 23, 24 of the fluid supply housing 1 (block 250), for directing the fluids towards the middle region 3*a* of the head surface 3 toward the respective fluid slots 4*b*, 4*c*. The method may include subsequently ejecting the second and third fluid out of the second and third fluid slots 4*b*, 4*c*, respectively (block 260).

In one aspect of this disclosure, a fluid supply 2 is provided. In an example, the fluid supply 2 includes a fluid supply housing 1 and capillary material 11, 13, 14. In an example, the fluid supply housing 1 includes a head surface 3, at a first level 6. In an example, the fluid supply housing 1 includes a fluid slot 4 extending through the head surface 3. In an example, the fluid supply housing 1 includes a fluid chamber 5 for holding fluid, having a bottom 10 at a second level 7 that is distanced from the first level 6. For example, the distance d1 may be larger than 5 millimeter. In an example, the fluid supply housing 1 includes a fluid channel 8 between the fluid chamber 5 and the fluid slot 4, wherein the fluid channel 8 provides for a straight passageway 9, 43, 44 that extends straight from the fluid chamber 5 to the fluid slot 4 and that has a constant slope a of between approximately 113° and approximately 133° with respect to the head surface 3. For example, the capillary material 11 extends within the fluid channel 8. For example, the capillary material 11 comprises a foam block and extends in the fluid channel 8 parallel to the passageway 9, 43, 44. For example, the foam block 11 extends at a similar angle α with respect to the head surface 3 as the passageway 9, 43, 44. In an example, the foam block 11 has a rectangular cross section so that it abuts the fluid channel walls. In an example, the passageway 9, 43, 44 has an angle α of between 120° and 126° with respect to the head surface 3. In an example, the fluid supply housing 1 includes a first chamber 33 at a front 20 and a second and third chamber 40, 41 at a back 19. In an example, a first fluid channel 38 connects to the first chamber 33, has a passageway 39 that extends straight downwards to connect to a first fluid slot 4*a*. In an example, a second and third fluid channel 40, 41 connecting to a second and third chamber 34, 35, respectively, having second and third straight passageways 43, 44 from the respective fluid chamber 34, 35 to the respective fluid slot 4*b*, 4*c* at said constant slope a of between approximately 113° and approximately 133° with respect to the head surface 3. In an example, the second and third fluid channels 40, 41 have an angle β with respect to side walls 23, 24 of the fluid supply housing 1 of between approximately 10° and 20°, towards a middle section 3*a* of the head surface 3, to connect to corresponding second and third fluid slots 4*b*, 4*c*, respectively. In an example, the second and third fluid channels comprise side walls 55, 56, 57, 58 that have angles β of between approximately 13° and 17° with respect to the housing side walls 23, 24, for example as seen from a view perpendicular to the head surface 3, for example the top view of FIG. 5. In an example, the first fluid slot 4*a* is arranged closer to the front wall 31 of the fluid supply housing 1 than the second and third fluid slot 4*b*, 4*c* and the second and third fluid slot 4*b*, 4*c* are arranged at an equal distance from the front wall 31 of the fluid supply housing 1. In an example, the fluid supply housing 1 includes three parallel longitudinal head channels 28, 29, 30 of equal dimensions, including a first longitudinal head channel 28 in the middle of the head surface 3 and a second and third longitudinal head channel 29, 30 at both sides of the first longitudinal head channel 28. For example, the first fluid slot 4*a* opens into the first longitudinal head channel 28 at a distance from end points of the first longitudinal head channel 28. The second and third fluid slots 4*b*, 4*c* open into the second and third longitudinal head channels 29, 30, respectively, at respective ends of the second and third longitudinal head channels 29, 30. In an example, the second and third fluid channels 40, 41 comprise a wedge shaped portion 64, 65 close to the fluid slot 4*b*, 4*c*. For example, the wedge shaped portion 64, 65 is defined by an outer fluid channel side wall 72, 73, respectively, that extends inwards, narrowing the respective fluid channels 40, 41 near the respective fluid slots 4*b*, 4*c*. In an example, the fluid supply housing 1 is a single cast solid piece.

The above description is not intended to be exhaustive or to limit this disclosure to the examples disclosed. Other variations to the disclosed examples can be understood and effected by those skilled in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A fluid supply, comprising a fluid supply housing, comprising a head surface, at a first level, a number of fluid chambers for holding fluid, at least one fluid chamber having a bottom at a second level that is distanced from the first level, a number of fluid slots extending through the head surface, at least one fluid slot associated with a front chamber being arranged closer to a front wall of the fluid supply housing than a number of secondary fluid slots, a number of fluid channels, wherein:

the number of fluid channels provide for a straight passageway that extends straight from a corresponding fluid chamber until a corresponding fluid slot and at least one fluid channel has a constant slope of between approximately 113° and approximately 133° with respect to the head surface, and capillary material extending in the fluid channel.

2. The fluid supply of claim 1 wherein the capillary material comprises a foam block, and extends in the fluid channel parallel to the passageway, abutting the fluid channel walls.

3. The fluid supply of claim 2 wherein the foam block has a rectangular cross section.

4. The fluid supply of claim 1, wherein the passageway has an angle of between 120° and 126° with respect to the head surface.

5. The fluid supply of claim 1, wherein the fluid supply housing comprises:

a first chamber at a front and a second and third chamber at a back, a first fluid channel that connects to the first chamber, having a passageway extending straight downwards to connect to a first fluid slot, and a second and third fluid channel connecting to the second and the third chamber, respectively, having second and third straight passageways from the respective second chamber and the third chamber until a respective second fluid slot and third fluid slot at said constant slope of between approximately 113° and approximately 133° with respect to the head surface.

6. The fluid supply of claim 5, wherein the second and third fluid channels have an angle with respect to side walls of the fluid supply housing of between approximately 10° and 20°, towards a middle section of the head surface, to connect to corresponding second and third fluid slots, respectively.

7. The fluid supply of claim 6, wherein the second and third fluid channels comprise side walls that have angles of between approximately 13° and 17° with respect to the housing side walls.

8. The fluid supply of claim 5, wherein the first fluid slot is arranged closer to a front wall of the fluid supply housing than the second and third fluid slot and the second and third fluid slot are arranged at an equal distance from the front wall of the fluid supply housing.

9. The fluid supply of claim 8, wherein the fluid supply housing comprises three parallel longitudinal head channels of equal dimensions, including a first longitudinal head channel in the middle of the head surface and a second and third longitudinal head channel at both sides of the first longitudinal head channel, wherein the first fluid slot opens into the first longitudinal head channel at a distance from ends of the first longitudinal head channel, and the second and third fluid slots open into the second and third longitudinal head channels, respectively, at respective ends of the second and third longitudinal head channels.

10. The fluid supply of claim 1, wherein the second and third fluid channels comprise wedge shaped portions close to the respective fluid slots, the wedge shaped portions being defined by respective outer fluid channel side walls that extend inwards, narrowing the respective fluid channels near the fluid slots.

11. The fluid supply of claim 1 wherein the fluid supply housing is a single cast solid piece.

12. A method of supplying fluid, comprising fluid travelling within a fluid supply housing from a fluid chamber to a fluid slot that is distanced from the fluid chamber, the fluid travelling within a fluid channel, through capillary material that is in an inclined orientation, along a passageway that is straight and has a constant slope of between 120° and 126° with respect to a head surface of the fluid supply housing, and the fluid travelling through the fluid slot in the head surface at the end of the passageway.

13. The method of supplying fluid of claim 12, comprising a first fluid of a first type travelling in capillary material, relatively straight downwards from a first chamber to a first fluid slot, the first chamber being arranged near the front of the fluid supply housing and the first fluid slot being arranged between a second and third fluid slot, ejecting the first fluid out of the first slot, a second and third fluid being of a second and third type, respectively, different from the first type, travelling from a second and third chamber to a corresponding second and third fluid slot along respective straight passageways that are constantly sloped at between 120° and 126° through capillary blocks that have an equally inclined orientation, and ejecting the second and third fluid out of the second and third slot, respectively.

14. The method of supplying fluids of claim 13, wherein the second and third fluids travel between the respective chambers and slots along respective passageways that diverge towards a middle section of the head surface, at angles of between approximately 10° and 20° with respect to side walls of the housing, to guide the fluid towards the respective second and third fluid slot that are arranged in the middle section of the head surface, below the first chamber.

15. A fluid supply, comprising, a front chamber for holding a first fluid type, a back chamber, for holding a second fluid type different than the first fluid type, a head surface at least partially below the front chamber containing fluid slots, a fluid channel extending from the back chamber to a respective fluid slot for transporting the second fluid type from the back chamber to the slot, and capillary material extending in the fluid channel, wherein the fluid channel comprises a passageway that is straight along its length and has a constant slope of between approximately 113° and 133° with respect to and approximately up to the head surface; and wherein the front chamber, back chamber, or combinations thereof comprise an inner separation wall within the chamber to provide an inner volume within the chamber.

16. The method of claim 12, wherein the fluid is gas.

17. The fluid supply of claim 9, wherein the fluid slots are less than half of the longitudinal head channels.

18. The fluid supply of claim 1, wherein the capillary material is in an inclined orientation.

* * * * *

UNITED STATES PATENT AND TRADEMARK OFFICE

CERTIFICATE OF CORRECTION

PATENT NO. : 8,857,960 B2
APPLICATION NO. : 13/284470
DATED : October 14, 2014
INVENTOR(S) : Teck Keong Ng et al.

It is certified that error appears in the above-identified patent and that said Letters Patent is hereby corrected as shown below:

In the Claims,

In column 8, line 27, in Claim 1, delete “slot” and insert -- slot, --, therefor.

In column 10, line 10, in Claim 14, delete “fluids” and insert -- fluid --, therefor.

In column 10, line 34, in Claim 16, delete “gas” and insert -- a gas --, therefor.

Signed and Sealed this
Twenty-fourth Day of February, 2015

Michelle K. Lee

Michelle K. Lee
*Deputy Director of the United States Patent and Trademark Office*